US008134508B2

(12) United States Patent
Learmonth et al.

(10) Patent No.: US 8,134,508 B2
(45) Date of Patent: Mar. 13, 2012

(54) WIRELESS, COMPUTER-PERIPHERAL DEVICE

(75) Inventors: Iain Thomas Learmonth, Basingstoke (GB); Musa Ibrahim Kakish, Anaheim, CA (US); Yin H. Chen, Irvine, CA (US)

(73) Assignee: I/O Interconnect Limited, Santa Ana, CA (US)

( * ) Notice: Subject to any disclaimer, the term of this patent is extended or adjusted under 35 U.S.C. 154(b) by 411 days.

(21) Appl. No.: 12/460,337

(22) Filed: Jul. 17, 2009

(65) Prior Publication Data

US 2010/0013734 A1 Jan. 21, 2010

Related U.S. Application Data

(60) Provisional application No. 61/135,060, filed on Jul. 17, 2008.

(51) Int. Cl.
*H01Q 1/24* (2006.01)

(52) U.S. Cl. ..... 343/702

(58) Field of Classification Search ..... 343/702, 343/880, 881

See application file for complete search history.

(56) References Cited

U.S. PATENT DOCUMENTS

| | | | | |
|---|---|---|---|---|
| 6,172,645 | B1 * | 1/2001 | Hollander et al. | 343/702 |
| 6,522,299 | B2 * | 2/2003 | Beard et al. | 343/702 |
| 6,556,170 | B2 * | 4/2003 | Northey | 343/700 MS |
| 6,933,896 | B2 * | 8/2005 | Sward et al. | 343/702 |
| 7,509,143 | B2 * | 3/2009 | Lintern et al. | 455/558 |

* cited by examiner

*Primary Examiner* — Hoang V Nguyen

(57) ABSTRACT

A CWUSB, ExpressCard card has a body with an internal slide in the form of a deep rectangular slot. Accommodated in the slot is an aerial unit in two parts pivotally connected together. The slot has sides to the slot and slightly over-hung ends. The first part has a major portion with a width to slide in the slot and a minor portion with a reduced width that is able to protrude between the over-hung ends in an extended position of the aerial unit. The minor portion has pivot points. The second part is longer and has the reduced width whereby it can pass between the overhung ends. The inner end of the second part has complementary pivot points, whereby the parts are pivotally connected. The parts molded to locate a torsion spring, which biases the second part upwards with respect to the first part.

10 Claims, 3 Drawing Sheets

WIRELESS, COMPUTER-PERIPHERAL DEVICE

CROSS REFERENCE TO RELATED APPLICATION

This application takes priority from and claims the benefit of Provisional Application Ser. No. 61/135,060 filed on Jul. 17, 2008 the contents of which are hereby incorporated by reference.

BACKGROUND OF THE INVENTION

1. Field of the Invention

The present invention relates to a computer-peripheral device, capable of communicating wirelessly, that is a wireless computer-peripheral device.

2. Description of the Related Art

Ultra WideBand radio is used for wireless communication between computers and their peripherals. For instance, a CWUSB (Certified Wireless Universal Serial Bus) interface is an Ultra WideBand device, with which a suitably equipped computer can communicate wirelessly with a peripheral device incorporating another such interface. Existing laptops, not having CWUSB capability built in, can be retro-fitted with the capability by means of a CWUSB ExpressCard device, that is a card device in accordance with the ExpressCard standard of the Personal Computer Memory Card International Association—referred to herein as an ExpressCard card.

Ultra WideBand antennas can be formed from PCB traces in specific geometric patterns, but an unusual proximity effect has been observed when such an antenna is close to a planar surface comprised of non-metal material such as a table or desk of wood or plastic. This effect is distinct from attenuation that metal surfaces can cause. Antenna performance is significantly reduced when the active portion of the antenna is within 50 mm of the planar surface.

The height of an ExpressCard slot in a lap top computer is typically 15 mm above the surface on which the computer is placed, thus any antenna element in an ExpressCard card portion protruding from the computer's ExpressCard slot would be well within the zone in which antenna performance would be adversely affected.

SUMMARY OF THE INVENTION

The object of the present invention is to provide an improved Ultra WideBand wireless ExpressCard card and other wireless, computer-peripheral devices According to the invention there is provided a wireless, computer-peripheral device comprising a body formed to have a normal orientation with respect to a support surface and having:

a slide at least substantially parallel in use to the support surface and circuitry adapting the peripheral device for its operation, the circuitry including an aerial driver, an aerial unit slidably arranged with respect to the body for movement between a retracted position and an extended use position, the aerial unit having a first member formed complementarily with the slide for sliding along it between the two positions, a pivotal connection on the first member;

a second member connected to the first member via the pivotal connection and movable with the first member, the second member being substantially aligned with the slide in the retracted position of the aerial unit, a spring at the pivotal connection and acting between the first member and the second member for lifting the second member to a position substantially perpendicular to the slide when the first member is in the extended position and an aerial element in the second member remote from the first member, the aerial element being flexibly connected to the aerial driver and spaced from the support surface when the second member is lifted by its spring.

The invention is particularly suitable for Ultra WideBand wireless, but is not restricted to it.

The body can be scalloped to allow an outer end of the aerial unit to be gripped for its movement from the retracted position, in which it can be held by a detent latch. Alternatively, the aerial unit can be sprung from its retracted position by a slide spring and adapted to be held there by a push-push latch engaged by pushing of the unit in against the slide spring.

Normally the aerial unit will be held in its extended use position by action of the pivot spring, urging the second member against a portion of the body.

The peripheral device can incorporate a switch for switching the device ON, the switch being made when the aerial unit is in its extended position. Alternatively, as in the preferred embodiment, the switch can be incorporated with the latch.

In the preferred embodiment, the second member incorporates an LED, lit when the device is switched on.

In accordance with another aspect of the invention, there is provided a wireless, computer-peripheral device comprising:

a body formed to have a normal orientation with respect to a support surface;

circuitry adapting the peripheral device for its operation, the circuitry including an aerial driver;

a pivotal connection on the body;

an aerial unit connected to the body the pivotal connection for movement between a retracted position at least substantially within the outline of the body and an extended use position in which the aerial unit extends away from the support surface;

an aerial element in the aerial unit remote from the body in the extended position and connected to the aerial driver;

a spring at the pivotal connection and acting between the body and the aerial unit to move the aerial unit to the use position;

a latch for holding the aerial unit in the retracted position against the action of the spring; and a switch for switching on the circuitry, the switch being made when the aerial unit is in the extended position.

BRIEF DESCRIPTION OF THE DRAWINGS

To help understanding of the invention, a specific embodiment thereof will now be described by way of example and with reference to the accompanying drawings, in which.

DETAILED DESCRIPTION OF THE PREFERRED EMBODIMENT

Figure 1:
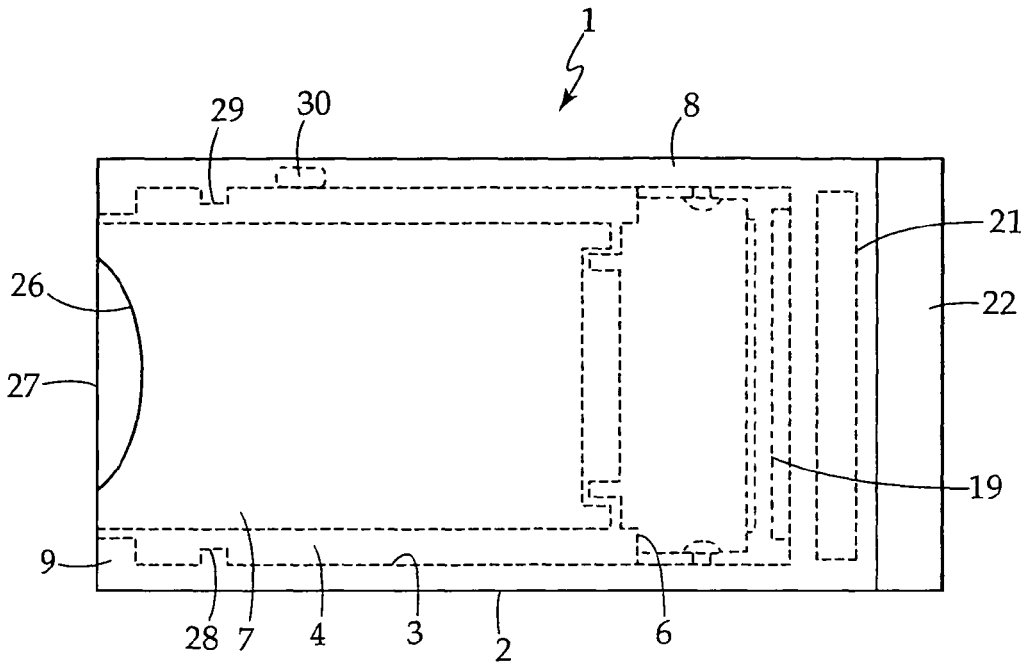
FIG. 1 is a plan view of a CWUSB, ExpressCard card in accordance with the invention.
Figure 2:
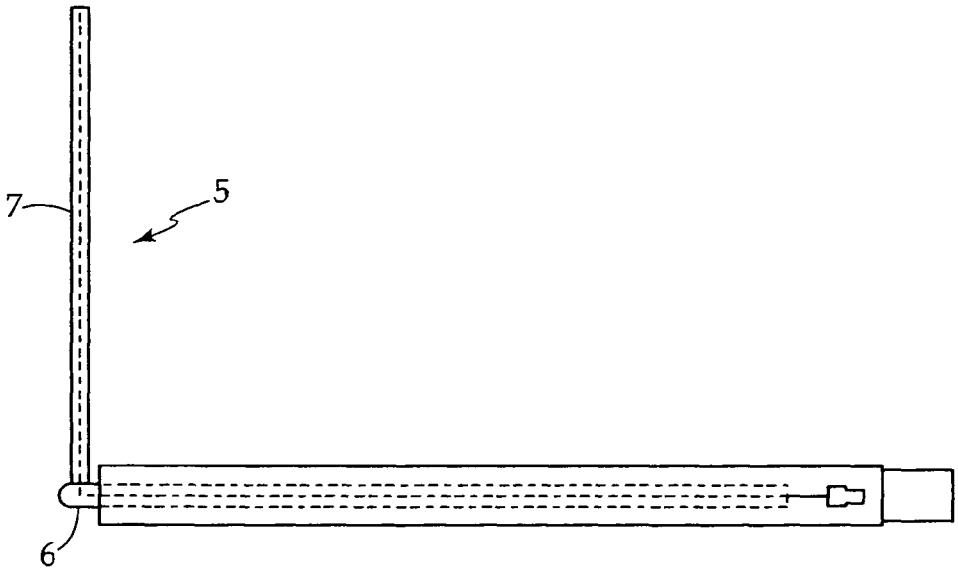
FIG. 2 is a side view of the card with its aerial extended.
Figure 3:
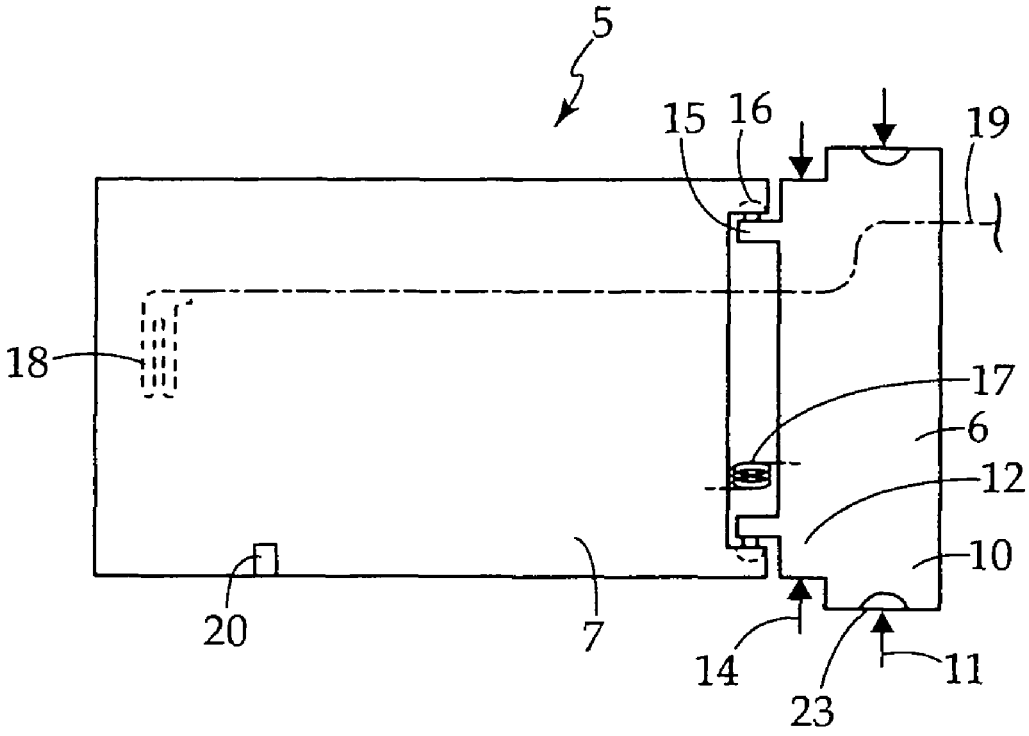
FIG. 3 is a view similar to FIG. 1 of the card's aerial unit alone.
Figure 4:
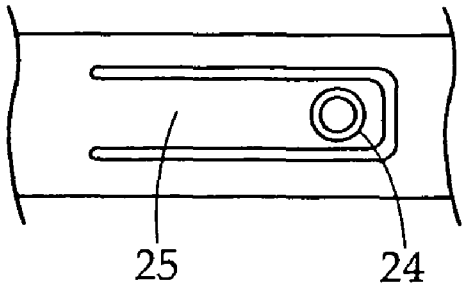
FIG. 4 is a scrap view of a detent pip and leg in the body of the card.
Figure 5:
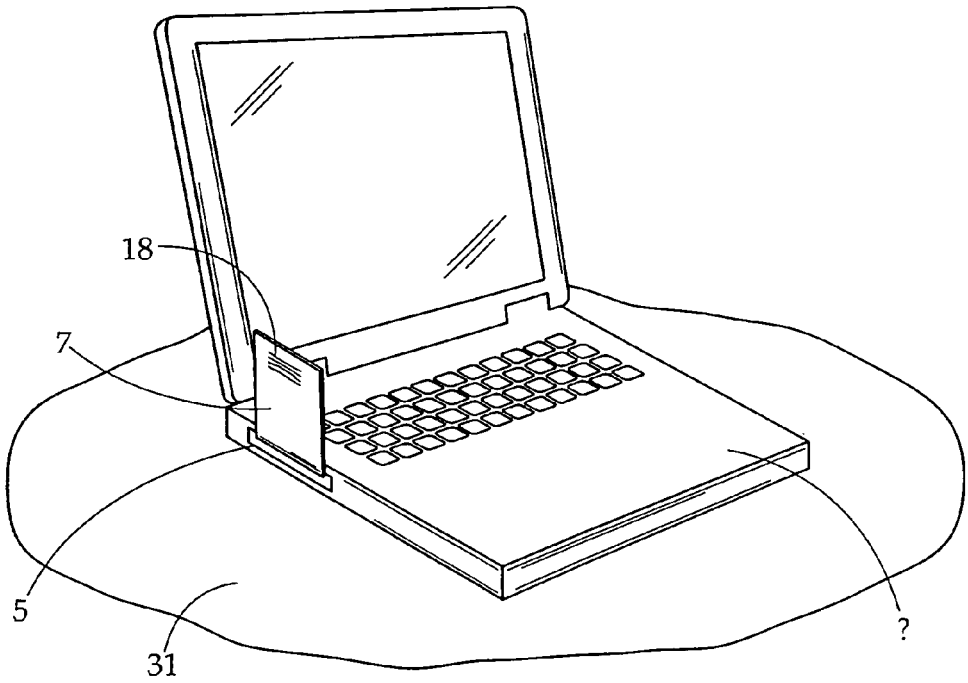
FIG. 5 is a perspective view of the card installed in a computer.

Referring to FIGS. 1 to 5 of the drawings, a CWUSB, ExpressCard card 1 has a body 2 with an internal slide 3 in the form of a deep rectangular slot 4. Accommodated in the slot is an aerial unit 5 in two parts 6, 7 pivotally connected together.

The slot is formed in a plastics injection moulding 8 defining sides to the slot and slightly over-hung ends 9. The first part 6 has a major portion 10 with a width 11 to slide in the slot and a minor portion 12 with a reduced width 14 that is able to protrude between the over-hung ends 9 in an extended position of the aerial unit. The minor portion has pivot points 15.

The second part 7 is longer than the first part and has the same, reduced width whereby it can pass between the over-hung ends 9. The inner end of the second part has complementary pivot points 16, whereby the parts are pivotally connected. The parts moulded to locate a torsion spring 17, which biases the second part upwards with respect to the first part. Within the second part is a printed aerial 18, connected to a flexible cable 19, which is arranged to pass between the parts and out the back of the first part into the slot. The cable includes a pair of lines (not shown) for an LED 20.

The body includes circuitry 21 and an ExpressCard connector 22. The circuitry includes an aerial driver, not shown discretely, to which the cable 19 is connected.

The major portion 10 of the first part has detent notches 23 on either side and the moulding 8 has detent pips 24 on resilient legs 25 extending in sides of the slot. When the aerial unit is full inserted in the slot—its retracted position—the pips engage in the notches, retaining the aerial unit.

The orifice end of the slot has scallops 26 between the over-hung ends 9. When the aerial unit is retracted, the distal end 27 of the second part is flush with the ends 9, but can be gripped at the scallops. Withdrawal is stopped when the major portion meets the over-hung ends. In this position, a pip and leg 28 on one side engages one of the notches. A finger 29 of a micro-switch 30 engages the other, whereby the circuitry is switched on. The spring erects the second part. The aerial 18 is moved up. The length of the second part is such that the aerial is lifted more than 50 mm from the desk surface 31 on which a computer C having the card 1 in its card slot S.

Figure 6:
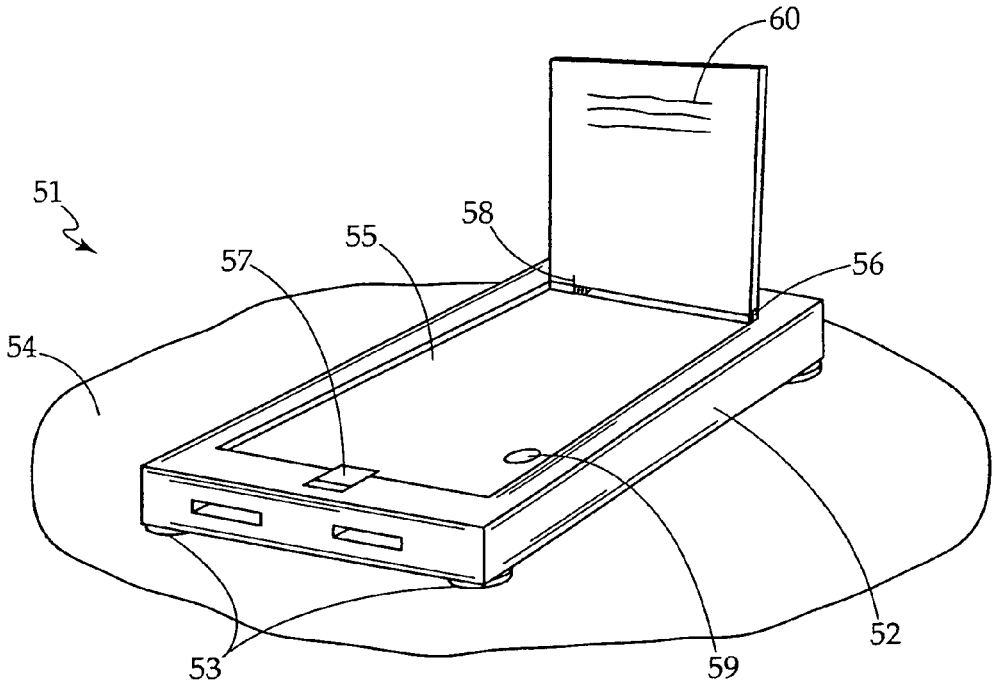
FIG. 6 is a perspective view of a CWUSB hub in accordance with the invention.

Turning on to FIG. 6, there is shown a CWUSB hub 51 to pass data from/to a CWUSB host to/from other devices such as printers and scanners. It has a body 52 with a dimple feet 53 determining its orientation with respect to the desk top 54. It has a recess 55, with a pivot 56 at one end for an aerial unit akin to that of the embodiment of FIGS. 1 to 5. A latch 57 normally retains the aerial unit in its retracted position in the recess. Release of it allows a spring 58 to lift the aerial for unit, with a switch 59 switching on circuitry for operation of the hub. The aerial 60 within the aerial unit is positioned such that it is more than 50 mm above the support surface 54 when in the upstanding position.

We claim:

1. A wireless, computer-peripheral device comprising:

a body formed to have a normal orientation with respect to a support surface and having:

a slide at least substantially parallel in use to the support surface; and circuitry adapting the peripheral device for its operation, the circuitry including an aerial driver; and an aerial unit slidably arranged with respect to the body for movement between a retracted position and an extended use position, the aerial unit having:

a first member formed complementarily with the slide for sliding along it between the two positions;

a pivotal connection on the first member;

a second member connected to the first member via the pivotal connection and movable with the first member, the second member being substantially aligned with the slide in the retracted position of the aerial unit;

a spring at the pivotal connection and acting between the first member and the second member for lifting the second member to a position substantially perpendicular to the slide when the first member is in the extended position; and an aerial element in the second member remote from the first member, the aerial element being flexibly connected to the aerial driver and spaced from the support surface when the second member is lifted by its spring;

wherein the slide is a slot having sides and over-hung ends, the first member has a major portion with a width to slide in the slot and a minor portion with a reduced width that is able to protrude between the over-hung ends in an extended position of the aerial unit, and the second member has the reduced width whereby it can pass between the overhung ends.

2. The wireless, computer-peripheral device, as claimed in claim 1, wherein the body is scalloped to allow an outer end of the aerial unit to be gripped for its movement from the retracted position.

3. The wireless, computer-peripheral device, as claimed in claim 2, including a detent latch for holding the aerial unit in its retracted position.

4. The wireless, computer-peripheral device, as claimed in claim 1, including: a slide spring for springing the aerial unit from its retracted position by and a push-push latch engaged by pushing of the unit in against the slide spring for holding the aerial unit in its retracted position.

5. The wireless, computer-peripheral device, as claimed in claim 1, wherein the pivot spring is adapted and arranged to hold the aerial in its extended use position by urging the second member against a portion of the body.

6. The wireless, computer-peripheral device, as claimed in claim 1, including a switch for switching the device ON; the switch being made when the aerial unit is in its extended position.

7. The wireless, computer-peripheral device, as claimed in claim 1, including a switch for switching the device ON, the switch being incorporated with the latch.

8. The wireless, computer-peripheral device, as claimed in claim 1, wherein the second member incorporates an LED, lit when the device is switched on.

9. The wireless, computer-peripheral device, as claimed in claim 1, wherein the device is a CWUSB, ExpressCard card.

10. The wireless, computer-peripheral device, as claimed in claim 1, wherein the aerial element is so positioned in the second member to be at least 50 mm (2 inches) from the support surface in use.

* * * * *